US006783822B1

(12) United States Patent
Faouaz

(10) Patent No.: US 6,783,822 B1
(45) Date of Patent: Aug. 31, 2004

(54) MUSLIM PRAYER COUNTER

(76) Inventor: Hassan Faouaz, 1025 Angela Ct., Schaumburg, IL (US) 60173

( * ) Notice: Subject to any disclaimer, the term of this patent is extended or adjusted under 35 U.S.C. 154(b) by 44 days.

(21) Appl. No.: 10/351,502

(22) Filed: Jan. 27, 2003

(51) Int. Cl.[7] ..... B32B 3/02
(52) U.S. Cl. ..... 428/34.1; 428/85; 428/192; 5/417
(58) Field of Search ..... 428/85, 192, 34.1; 5/417

(56) References Cited

U.S. PATENT DOCUMENTS 4,472,789 A * 9/1984 Sibley ..... 377/107

* cited by examiner

*Primary Examiner*—Alexander S. Thomas

(57) ABSTRACT

A Muslim prayer counter comprising a short upper edge and a parallel shrot lower edge with ling parallel side edges there between, the rug having an exposed planar upper surface and a lower surface adapted to be supported on a floor; a counter secured to the upper surface of the carper adjacent the upper edge in proximity to one side edge thereof; a switch located on the upper surface of the carper mid-way between side edge; a battery secured to the lower surface of the rug adjacent the upper in proximity to the counter, the battery including an electrical lines coupling the counter and the battery and the switch.

4 Claims, 4 Drawing Sheets

Fig.7

| QD | QC | QB | QA | OUTPUT DISPLAYED |
|---|---|---|---|---|
| 0 | 0 | 0 | 0 | 0 |
| 0 | 0 | 0 | 1 | 0 |
| 0 | 0 | 1 | 0 | 1 |
| 0 | 0 | 1 | 1 | 1 |
| 0 | 1 | 0 | 0 | 2 |
| 0 | 1 | 0 | 1 | 2 |
| 0 | 1 | 1 | 0 | 2 |
| 0 | 1 | 1 | 1 | 3 |
| 1 | 0 | 0 | 0 | 4 |
| 1 | 0 | 0 | 1 | 4 |
| 1 | 0 | 1 | 0 | RESET |

MUSLIM PRAYER COUNTER

BACKGROUND OF THE INVENTION

1. Field of the Invention

The present invention relates to Muslim prayer counter and more particularly pertains to displaying the number of times prayers are said through the number of times a switch is contacted by user's head.

2. Description of the Prior Art

The use of rugs is known in the prior art as is the use of counters. More specifically, rugs and counters and combinations thereof in various designs and configurations heretofore devised and utilized for the purpose of counting any of a number of types of events through various methods and apparatuses are know to consist basically of familiar, expected, and obvious structural configurations, not withstanding the myriad of designs encompassed by the crowded prior art which has been developed for the fulfillment of countless objectives and requirements.

By way of example, U.S. Pat. No. 4,472,789 to Sibley disclose a vital timer for energizing a vital relay at the end of a preselected time interval generated by a vitally programmed microprocessor.

U.S. Pat. No. 4,727481 to Aguille et al. discloses an addressing device for a memory, such as a dynamic memory ROM or RAM, addressable by address words at a predetermined clock-period rate.

U.S. Pat. No. 4,833,629 to Moore disclosed an apparatus for categorizing and accumulating events.

U.S. Pat. No. 5,177,771 to Glassburn discloses a high-resolution symmetrical divider circuit.

Lastly, U.S. Pat. No. 5,274,775 to Croson discloses a process control apparatus for executing program instructions.

In this respect, the Muslim prayer counter according to the present invention substantially departs from the conventional concepts and designs of the prior art, and in doing so provides an apparatus primarily developed for the purpose of displaying the number of times prayers are said through the number of times a switch is contacted by a user's head.

Therefore, it can be appreciated that there exists a continuing nee for a new and improved Muslim prayer counter, which can be used for displaying the number of times prayers are said through the number of times a switch is contacted by a user's head. In regard, the present invention substantially fulfills the need.

SUMMARY OF THE INVENTION

In view of the foregoing disadvantages inherent in the know types of rugs and counters and combinations thereof in various designs and configurations now present in the prior art, the present invention provides an improved Muslim prayer counter. As described subsequently in greater detail, is to provide a new and improved Muslim prayer counter and method which has all the advantages of the prior art and none of the disadvantages.

To attain this, the present invention essentially comprises a Muslim prayer counter that is used in displaying the number of times prayers are said through the number of times a switch is contacted by a user's head comprising, in combination a rug having a short upper edge and a parallel short lower edge with exposed planar upper surface and a lower surface adapted to be supported on a floor; a counter secured to the upper surface of the rug adjacent the upper edge in proximity to one side edge thereof, the counter also including a slide switch button adapted to be contacted by a user to turn on or off the counter; a switch located on the upper surface of the rug mid-way between side edges; a battery secured to the lower surface of the rug adjacent the upper in proximity to the counter, with an associated pocket for removably receiving the batter for replacement purposes, the battery including an electrical lines coupling the counter and the battery and the switch, with associated electrical lines coupling the battery and the switch, the batter and the counter, and the switch and the counter, the switch adapted to generate an electrical pulse to the counter for each time the switch is contacted and to advance the counter by one on alternate contacts of the switch by the user whereby the switch will read a whole number corresponding to half the number of times the switch is contacted.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are familiar with patent of legal terms or phraseology, to determine quickly from cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Muslim counter which have all the advantages of the prior art rugs and combinations thereof in various designs and configurations and none of the disadvantages.

It is another object of the present invention to provide a new and improved Muslim prayer counter which are of durable and reliable constructions.

An even further object of the present invention is to provide a new and improved Muslim prayer counter which are susceptible of a low cost of manufacture with regard to both materials and labor, and which accordingly are then susceptible of low prices of sales to the consuming public, thereby making such Muslim counter economically available to the buying public.

Still yet another object of the present invention is to provide a new and improved Muslim prayer counter which provide in the apparatuses and methods of the prior art some of the disadvantages normally associated therewith.

Even still another object of the present invention is to displaying the number of times prayers are said through the number of times a switch is contacted by a user's head.

Lastly, it is an object of the present invention to provide a new and improved Muslim prayer counter comprising a short upper edge and improved Muslim prayer counter comprising a short upper edge a parallel short lower edge-with long parallel side edges therebetween, the rug having an exposed planar upper surface and a lower surface adapted to be supported on a floor; a counter secured to the upper surface of the rug adjacent the upper edge in proximity to one side edge thereof; a switch located on the upper surface of the rug mid-way between side edges; a battery secured to the lower surface of the rug adjacent the upper in proximity to the counter, the battery including an electrical lines coupling the counter and the battery and the switch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other that those net forth above will become apparent when consideration is given to the following detailed description thereof. Such description makes reference to the annexed drawings wherein:

FIG. 7 is a table depicting the logical relationship between the ripple counter and BCD-7 segment decoder.

The same reference numerals refer to the same parts through the various Figures.

DESCRIPTION OF THE PREFERRED EMBODIMENT

Figure 1:
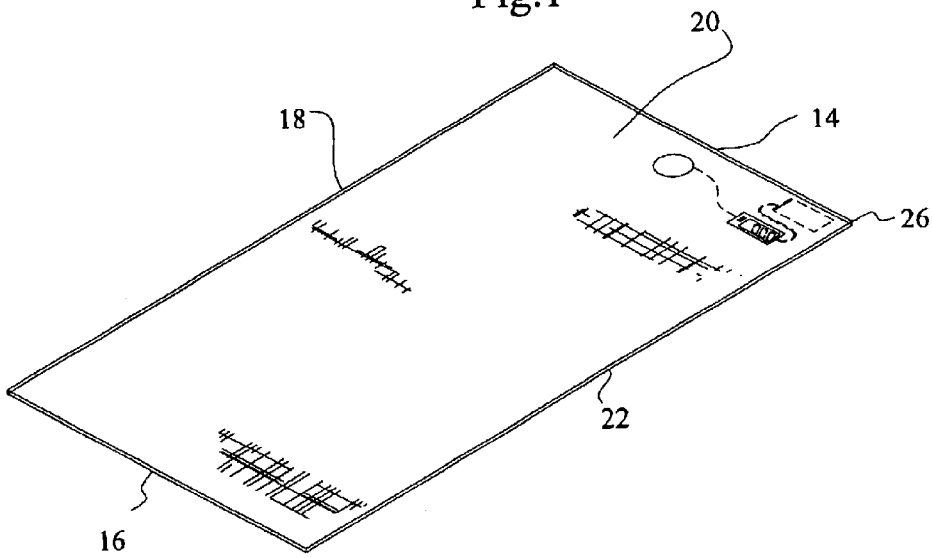
FIG. 1 is a perspective illustration of the preferred embodiment of the Muslim prayer counter constructed in accordance with the principles of present invention.

With reference now to the drawing, and in particular to FIG. 1 thereof, the preferred embodiment of the new and improved Muslim prayer counter embodying the principles and concepts of the present invention and generally designated by the reference numeral 10 will be described.

The present invention, the Muslim prayer rug 10 is comprised of plurality of components. Such components in their broadest context include a rug, a counter, a switch and a battery. Such components are individually configured and correlated with respect to each other so to attain the desired objective.

The present invention, a Muslim prayer rug for displaying the number of times prayers are said, may be construed as a system 10. Such system has as its primary component a rug 12. The rug is formed to have a short upper edge 14 and short lower edge 16. Such edges are parallel with each other. Coupling the upper and lower edges are long side edges 18. The long side edges function to couple the upper and lower edges.

As is conventional, the rug has an upper exposed surface 20 adapted for receiving the user of the rug thereon. The rug also has a lower planar surface 22. Such lower surface is adapted to be supported on a recipient surface such as a floor, not shown.

Formed into the lower side of the rug is a pocket 26. The pocket is rectangular in shape. It is located in one corner of the rug on the lower surface adjacent to the upper edge and one side edge, preferably on the right side during operation and user. The pocket has long parallel upper and lower edges and a short side edge in proximity to the adjacent side edge. It also has an opening opposite from the side edge for the positioning and removal of a battery 28 as may be required when power from the battery is expended.

Figure 2:
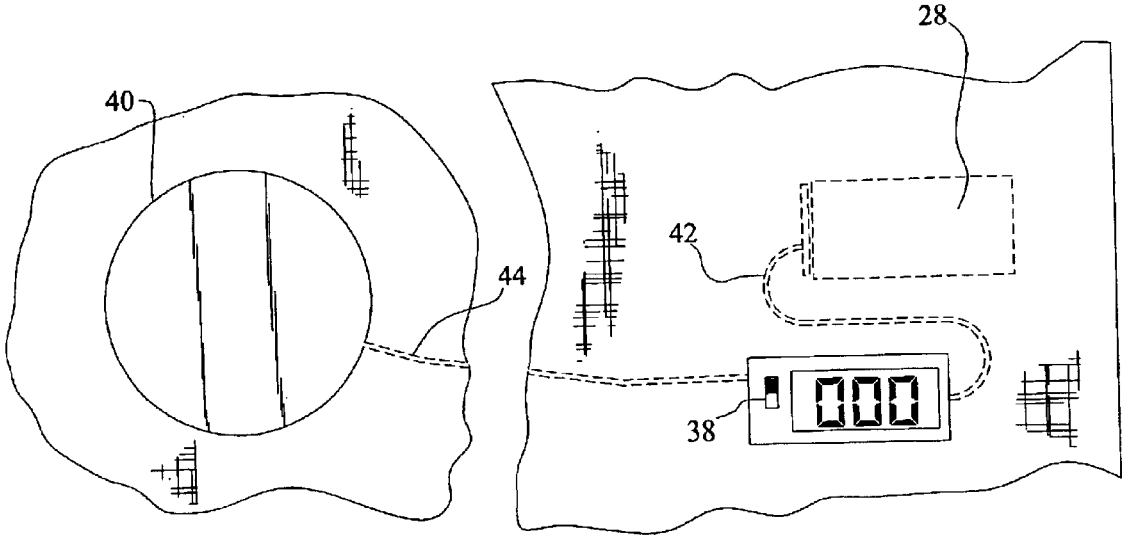
FIG. 2 is an enlarged top elevational view of the upper portion of the device shown in FIG. 1.

In association with the pocket is the battery 28. The battery is preferably a 9-volt battery of a rectilinear configuration. It is uniformed to have replaceable electrical lines 32 extending therethrough passing outwardly from the opening in the pocket. Note FIGS. 1 and 2. The purpose of the battery and wires will be later described.

Next provided is the counter. The counter is preferably an electrical counter. It is a preferably formed with a 7-segment light emitting diode 36 (LED) readout to indicate the number counted. The counter is secured to the upper edge in proximity to the side edge at a location close to the pocket and battery. The counter is secured there as through an adhesive or, in the alternative by stitching. As shown, three digits are utilized. More or less digits could be readily utilized as the function of the particular application.

Figure 4:
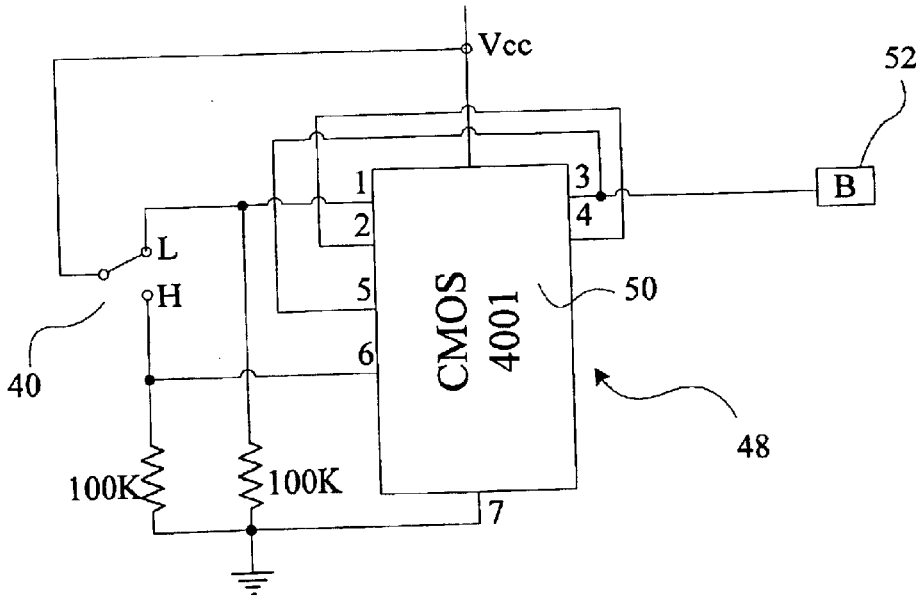
Figure 5:
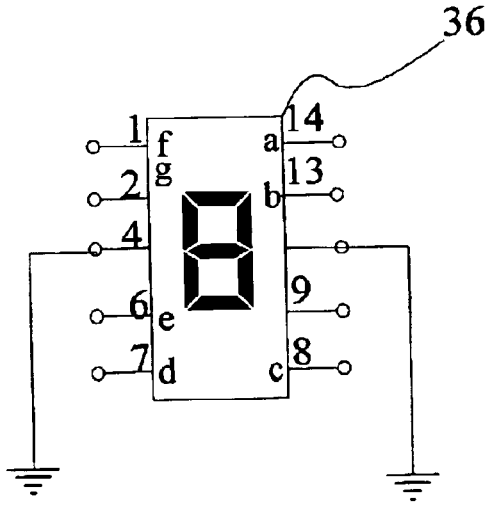
Figure 6:
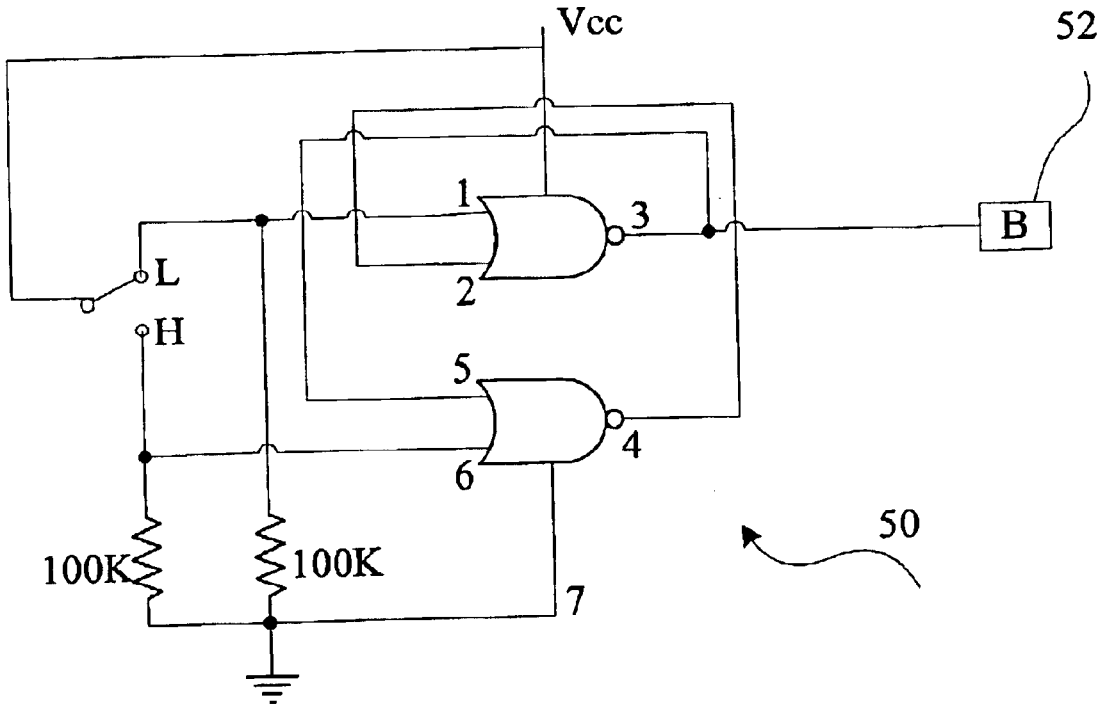
FIG. 6 is a logical diagram depicting the logic circuitry employed in the CMOS 4001 chip.

In association with the counter is a slide switch button 38. When slide, the button will turn on or off the counter function as will be later described. A switch 40 secured to the upper surface of the rug in proximity to the upper edge at a central location between the side edges of the rug. As shown in FIG. 4, the switch 40 has an unbiased orientation and a biased orientation. Electrical lines including a first line 42 coupling the battery and the counter, a second line 44 coupling the switch and the counter. Line 42 is for powering purposes. In this manner, when the switch is contacted by a user, it will generate a signal to the counter.

The counter is provided with appropriate programming components 48. It is whereby one of the first contacts the switch, the read-out will remain at zero but at the second contact with the switch, the counter will advance to 1. On the third contact the counter will record the pulse but not advance the counter. One of the fourth contact the counter will advance to 2. The manner is continued so long as the switch is contacted and the total number available through the number of digits on the counter will record a whole number corresponding to the total number of contacts made by the user to the switch. In other words, the total number on the read-out will be half the number of contacts made by the user on the switch.

Figure 3:
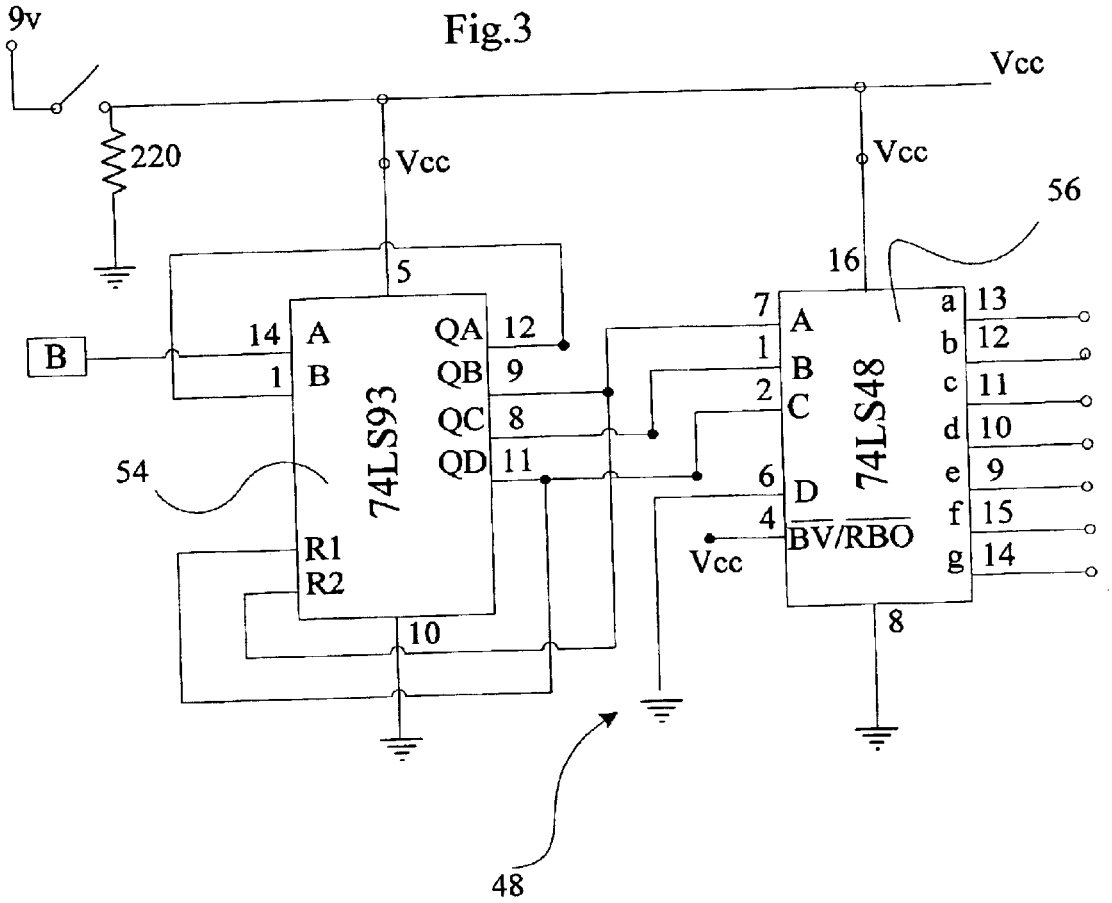
FIGS. 3, 4, and 5 are electrical schematics used in association with the device shown in FIG. 1.

To accomplish such, a CMOS 4001 chip 50 is connected to the switch 40 to create an on-momentary switch. The CMOS 4001 logic chip is adapted to produce and active high pulse at the output 52 thereof upon the toggling of the switch 40 from an unbiased orientation to a biased orientation and back to an unbiased orientation. A ripple counter 54 is connected to the output of the CMOS 4001 logic chip. The ripple counter is adapted to produce a binary representation between 0 and 16 of the amount of active high pulses received via the CMOS 4001 logic chip. As shown in FIG. 3, the inputs R1 and R2 and outputs QB and QD of the ripple counter are connected to specifically afford resetting of the ripple counter when both QB and QS are high. Also included is a BCD-7 segment decoder 56 connected between the ripple counter and the LED display. The BCD-7 segment decoder is adapted to convert the binary representation of the ripple counter output to a form employable by the LED display thus allowing proper displaying of a decimal number. The inputs of the BCD-7 segment decoder are connected merely to the thee most significant digits outputs of the ripple counter so as to increment the display upon every other receipt of an active high pulse by the ripple counter. The operability of both the ripple counter and BCD-7 segment decoder is illustrated in the logic table of FIG. 7.

The present invention is a rug with a counter for Muslims to use during their prayer rituals. It automatically counts the number of steps in their prayers, thereby relieving a person of the task of keeping track of this information. The present invention consists of a rug with an electric counter with a digital display. The counter measures roughly 8 centimeters by 2 centimeters, and it is powered by one 9-volt battery. Extending out from the counter by means of a short length of wire is a circular on/off switch. When Muslims pray, they touch their foreheads to the prayer rug numerous times. This, together with the numerous steps in a typical Muslim prayer, is what makes it difficult to keep track of how many steps of a prayer have been completed. In use, the user simply does their prayer ritual as usual, and the counter registers a new step completed for every two times the button is pushed with the forehead. In this manner, the user does not have to remember how many steps he or she has completed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationship to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, falling within the scope of the invention.

What is claimed as being new and desired to be protected by Letters Patent of the united states is as follows:

1. A new and improved Muslim prayer counter that is used in displaying the number of times prayers are said through the number of times a switch is contacted by a user's head comprising, in combination:

a rug having a short upper edge and a parallel short lower edge with long parallel side edges therebetween, the rug having an exposed planar upper surface and a lower surface adapted to be supported on a floor;

a counter secured to the upper surface of the rug adjacent the upper edge in proximity to one side edge thereof, the counter also including a slide button adapted to be contacted by a user to turn on or off the counter;

a switch located on the upper surface of the rug mid-way between side edges;

a battery secured to the lower surface of the rug adjacent to the upper edge in proximity to the counter with an associated pocket for removably receiving the battery for replacement purposes, the battery including an electrical line coupling the counter with the battery and with associated electrical lines coupling the battery and the counter, and the switch and the counter, the switch adapted to generate an electrical pulse to the counter for each time the switch is contacted and to advance the counter by one on alternate contacts of the switch by the user whereby the switch will read a whole number corresponding to half the number of times the switch is contacted.

2. A Muslim prayer counter comprising:

a rug having a short upper edge and a parallel short lower edge with long parallel side edges therebetween, the rug having an exposed planar upper surface and a lower surface adapted to be supported on a floor;

a counter secured to the upper surface of the rug adjacent the upper edge in proximity to one side edge thereof;

a switch located on the upper surface of the rug mid-way between side edges;

a battery secured to the lower surface of the rug adjacent the upper in proximity to the counter, the battery including electrical lines coupling the counter and the battery and the switch.

3. The device as set forth in claim 2 and further including:

an associated pocket for removably receiving the battery for replacement purposes.

4. The device as set forth in claim 2 wherein the counter includes a CMOS 4001 logic chip connected to the switch, the CMOS 4001 logic chip adapted to produce an active high pulse at an output thereof upon the toggling of the switch from unbiased orientation to a biased orientation and back to the unbiased orientation, a ripple counter connected to the output of the CMOS 4001 logic ship, the ripple counter adapted to produce a binary representation of the amount of active high pulses received via the CMOS 4001 logic chip, and a BCD-7 segment decoder connected between the ripple counter and a LED display, the BCD-7 segment decoder adapted to convert the binary representation of the ripple counter output to a form employable by the LED display thus allowing proper displaying of a decimal number, whereby the display shows a whole number corresponding to half the number of times the switch is contacted.

* * * * *